US008720454B2

(12) United States Patent
Santillan

(10) Patent No.: US 8,720,454 B2
(45) Date of Patent: May 13, 2014

(54) EYELASH CURLER

(71) Applicant: Veronica Santillan, Rancho Santa Fe, CA (US)

(72) Inventor: Veronica Santillan, Rancho Santa Fe, CA (US)

( * ) Notice: Subject to any disclaimer, the term of this patent is extended or adjusted under 35 U.S.C. 154(b) by 0 days.

(21) Appl. No.: 13/626,768

(22) Filed: Sep. 25, 2012

(65) Prior Publication Data

US 2013/0074865 A1 Mar. 28, 2013

Related U.S. Application Data

(60) Provisional application No. 61/539,425, filed on Sep. 26, 2011.

(51) Int. Cl.
*A45D 2/48* (2006.01)

(52) U.S. Cl.
USPC ..... 132/217

(58) Field of Classification Search
USPC ..... 132/216–218; D28/35, 36
See application file for complete search history.

(56) References Cited

U.S. PATENT DOCUMENTS

| | | | | | |
|---|---|---|---|---|---|
| 1,542,014 | A | * | 6/1925 | Stickel | 132/217 |
| 1,925,266 | A | * | 9/1933 | Manning | 132/217 |
| 1,970,086 | A | * | 8/1934 | Frost | 132/217 |
| 2,004,046 | A | * | 6/1935 | Glaser et al. | 132/217 |
| 2,022,697 | A | * | 12/1935 | Tuttle et al. | 132/217 |
| 2,252,742 | A | * | 8/1941 | Tuttle et al. | 132/217 |
| 2,391,047 | A | * | 12/1945 | Tuttle et al. | 132/217 |
| 2,411,519 | A | * | 11/1946 | Byron | 132/217 |
| 2,565,541 | A | * | 8/1951 | Wolff | 132/217 |
| 2,684,679 | A | * | 7/1954 | Kislig | 132/217 |
| 3,016,059 | A | * | 1/1962 | Hutton | 132/217 |
| 3,339,561 | A | * | 9/1967 | Brickner | 132/217 |
| D215,985 | S | * | 11/1969 | Silson | D28/36 |
| 3,625,229 | A | * | 12/1971 | Silson | 132/216 |
| 3,838,699 | A | * | 10/1974 | Skandalakis | 132/217 |
| 4,305,412 | A | * | 12/1981 | Nist | 132/217 |
| 4,791,944 | A | * | 12/1988 | Stein | 132/217 |
| 5,377,700 | A | | 1/1995 | Harris | |
| 5,598,858 | A | * | 2/1997 | Wainer | 132/217 |
| 5,944,028 | A | | 8/1999 | Gebhard | |
| 6,220,252 | B1 | | 4/2001 | Heintz | |
| 6,230,715 | B1 | * | 5/2001 | Cho | 132/217 |
| 6,325,071 | B1 | * | 12/2001 | Butcher | 132/218 |
| 6,662,809 | B2 | * | 12/2003 | Yamaguchi et al. | 132/217 |
| 6,789,551 | B2 | * | 9/2004 | Iosilevich | 132/217 |
| 7,055,529 | B2 | * | 6/2006 | Muraki et al. | 132/217 |
| 7,207,337 | B2 | * | 4/2007 | Park | 132/217 |
| 8,047,212 | B2 | * | 11/2011 | Lin | 132/217 |
| 8,291,920 | B2 | * | 10/2012 | Takata et al. | 132/218 |
| 2004/0112399 | A1 | * | 6/2004 | Chant | 132/218 |
| 2007/0163613 | A1 | * | 7/2007 | Lee | 132/216 |
| 2009/0056736 | A1 | * | 3/2009 | Suh | 132/217 |
| 2010/0043817 | A1 | * | 2/2010 | Haan | 132/211 |
| 2010/0224207 | A1 | * | 9/2010 | Otsuka et al. | 132/217 |
| 2011/0174328 | A1 | * | 7/2011 | Cerutti et al. | 132/200 |
| 2012/0160259 | A1 | * | 6/2012 | Nguyen et al. | 132/216 |

* cited by examiner

*Primary Examiner* — Robyn Doan
*Assistant Examiner* — Tatiana Nobrega
(74) *Attorney, Agent, or Firm* — Knobbe Martens Olson & Bear LLP

(57) ABSTRACT

An eyelash curler can be used to curl a user's eyelashes. The user can position the eyelashes within the eyelash curler to the eyelash curler can act on the eyelashes causing them to take on a desired shape or configuration. The eyelash curler can press the eyelashes between two members so that they take on or are move towards a desired shape or configuration.

15 Claims, 11 Drawing Sheets

EYELASH CURLER

CROSS-REFERENCE TO RELATED APPLICATIONS

This application claims the benefit of priority of U.S. Provisional Application No. 61/539,425, filed Sep. 26, 2011, entitled "EYELASH CURLER," which is incorporated by reference herein in its entirety and is to be considered a part of this specification.

BACKGROUND OF THE INVENTION

1. Field of the Invention

Embodiments of the present invention relate generally to eyelash curling and more particularly to an improved type of eyelash curler and may or may not employ heat.

2. Description of the Related Art

There exist a large variety of eyelash curlers. Some eyelash curlers may or may not employ heat to assist in curling the lash. Unfortunately, conventional eyelash curlers generally fail to accomplish the curling in a desirable manner.

SUMMARY OF THE INVENTION

Accordingly, there is a need for improved eyelash curlers for the natural curling of each eyelash area.

An eyelash curler can be used to curl a user's eyelashes where the user positions the eyelashes within the eyelash curler. The eyelash curler can press the eyelashes between two members so that they take on or are move towards a desired shape or configuration.

An eyelash curler of certain embodiments can comprise a first member, and a second member. Either the first member or the second member can be configured to move with relation to the other and the first and second members can be used to press form eyelashes between them. The first member can have a plurality of ridges that extend along a surface of the first member to reinforce a curl that is pressed into an eyelash, the surface having a plurality of flat surfaces which in the aggregate form a type of rounded surface.

In some embodiments, the eyelash curler can include one or more of the following features. The surface of the first member can comprise a micro textured surface. The surface of the first member can comprise a plurality of steps with angled linear segments between them. The surface of the first member can comprise a plurality of steps with straight linear segments between them. The surface of the first member can extend from a bottom most edge of the first member to a front most edge of the first member. The surface of the first member can extend from a back most edge of the first member to a top most edge of the first member. The plurality of flat surfaces can comprise three or more flat surfaces. The plurality of flat surfaces can comprise three or more flat surfaces with the same or with different angles between them. One or more of the flat surfaces may include a micro textured surface.

In some embodiments, an eyelash curler can comprise a first member, and a second member. Either the first member or the second member can be configured to move with relation to the other and the first and second members can be used to press form eyelashes between them. One of the first member and the second member can be made of a more flexible or softer material than the other. The first member can have a plurality of ridges that extend along a surface of the first member to reinforce a curl that is pressed into an eyelash, the surface having a plurality of flat surfaces which in the aggregate form a type of rounded surface. The second member can have a rounded surface.

According to certain embodiments, an eyelash curler can comprise a first member and a second member. Either the first member or the second member may be configured to move with relation to the other, the first and second members configured for press forming eyelashes between them. One of the first member and the second member can be made of a more flexible or softer material than the other. The first member can comprise a bottom edge configured to establish a point of contact with an eyelash, a front surface spaced away from the bottom edge, and a plurality intermediate surfaces that extend between the bottom edge and the front surface, wherein each junction between one of the intermediate surfaces and either one of the other intermediate surfaces or the front surface establishes a ridge configured to reinforce a curl that is pressed into an eyelash.

BRIEF DESCRIPTION OF THE DRAWINGS

Various embodiments are depicted in the accompanying drawings for illustrative purposes, and should in no way be interpreted as limiting the scope of the embodiments, in which like reference characters denote corresponding features consistently throughout similar embodiments.

DETAILED DESCRIPTION

Figure 1:
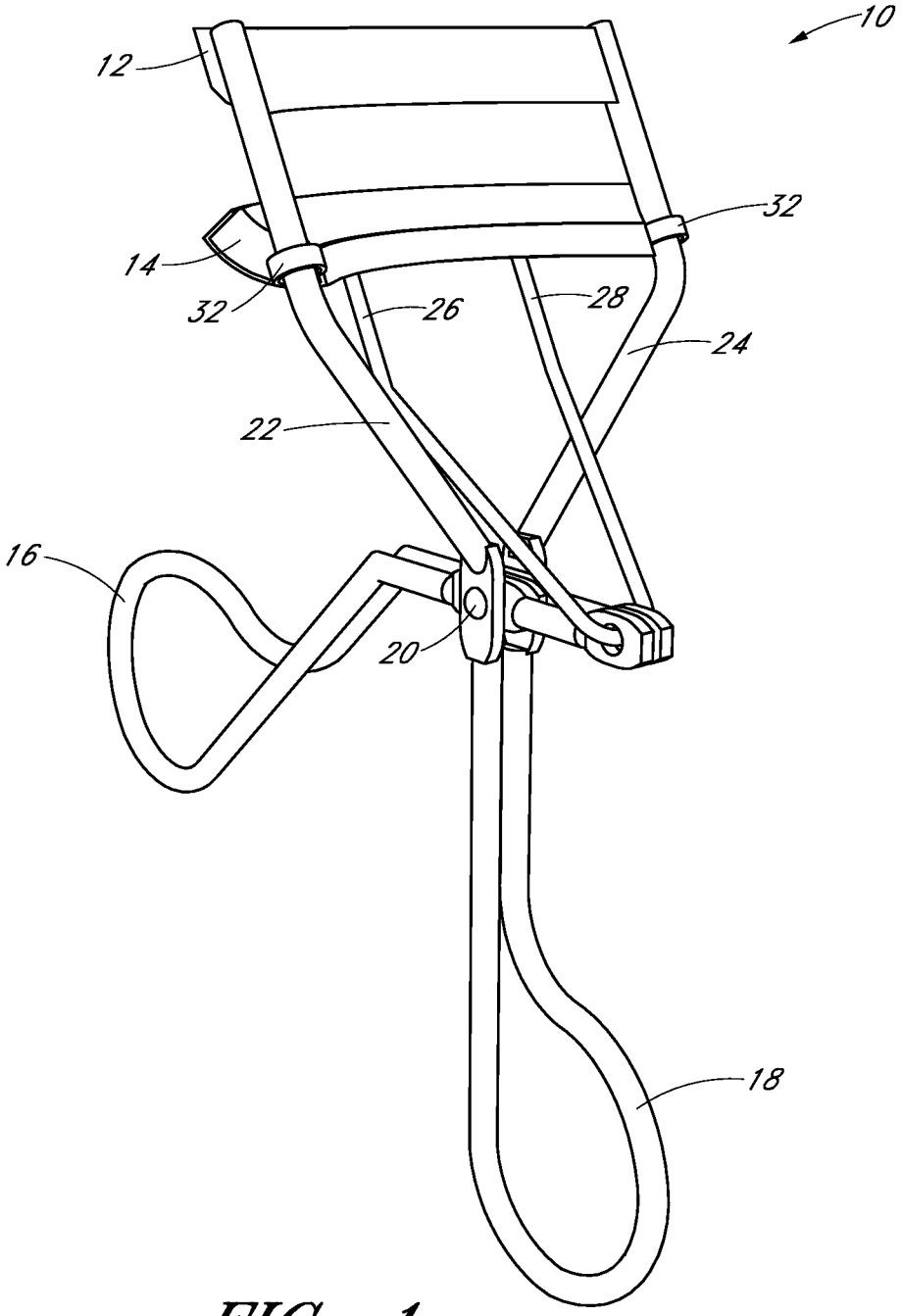
FIGS. 1 and 2 are perspective views of an eyelash curler.
Figure 2:
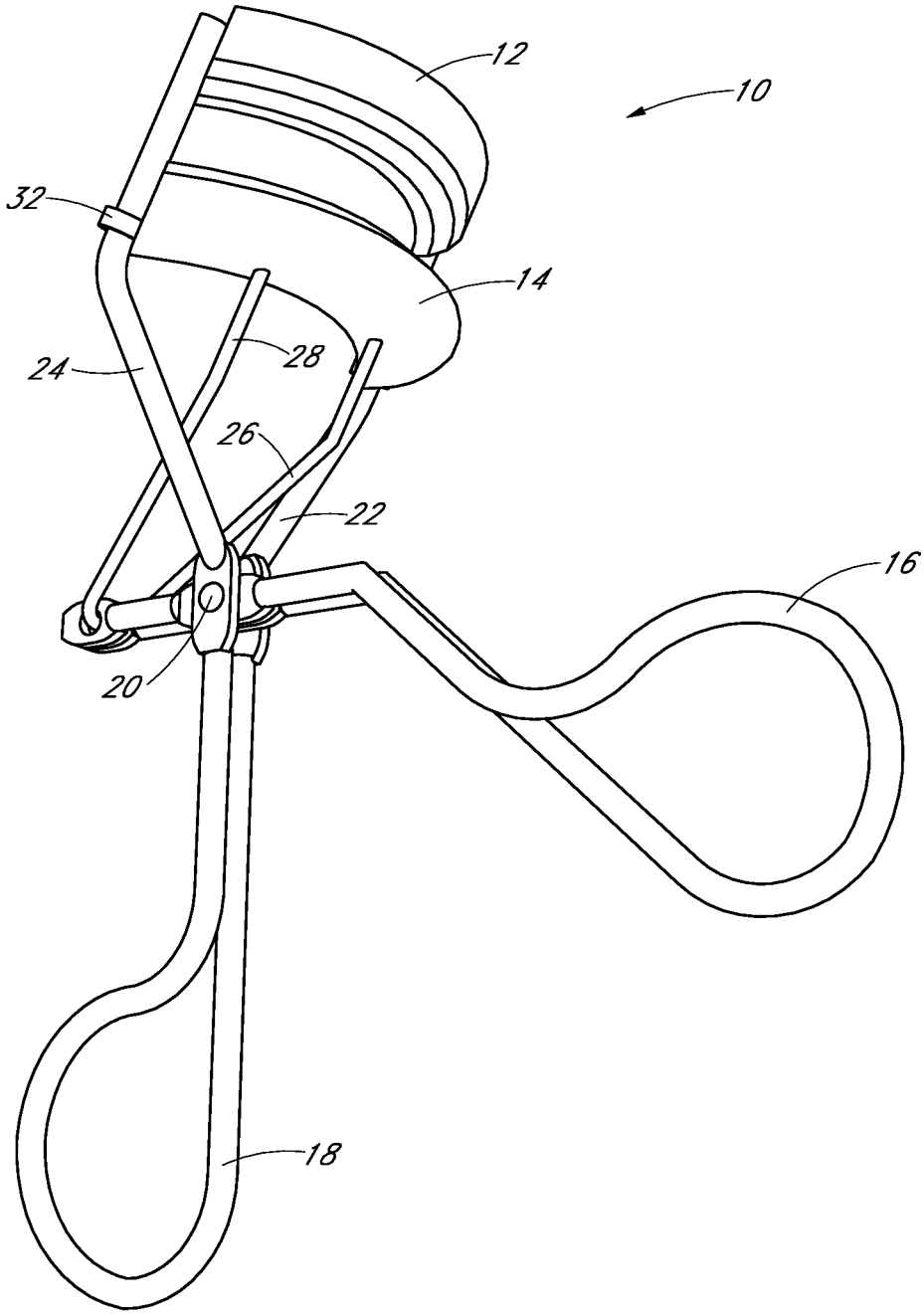
Figure 3:
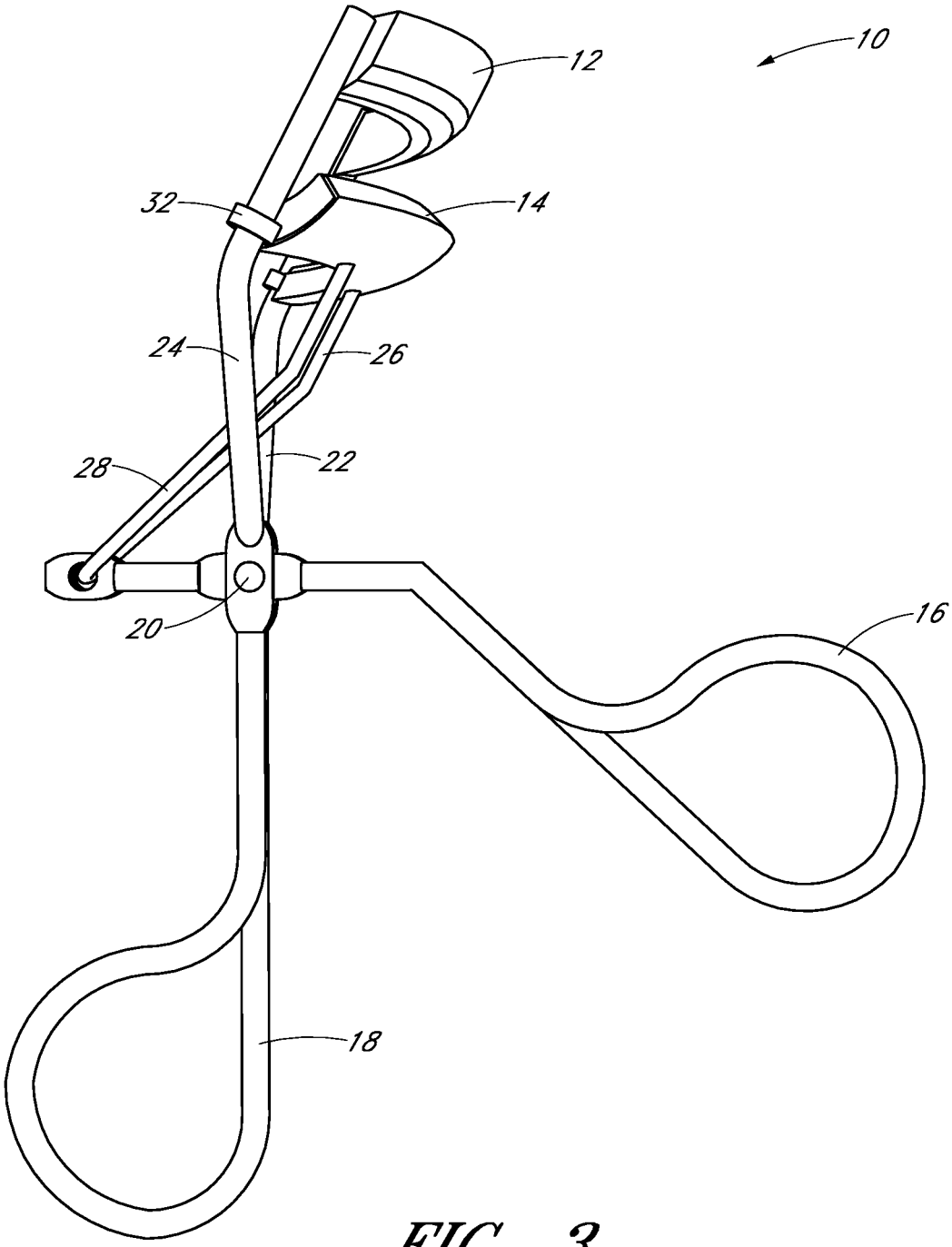
FIG. 3 is a side view of the eyelash curler of FIG. 1.
Figure 4:
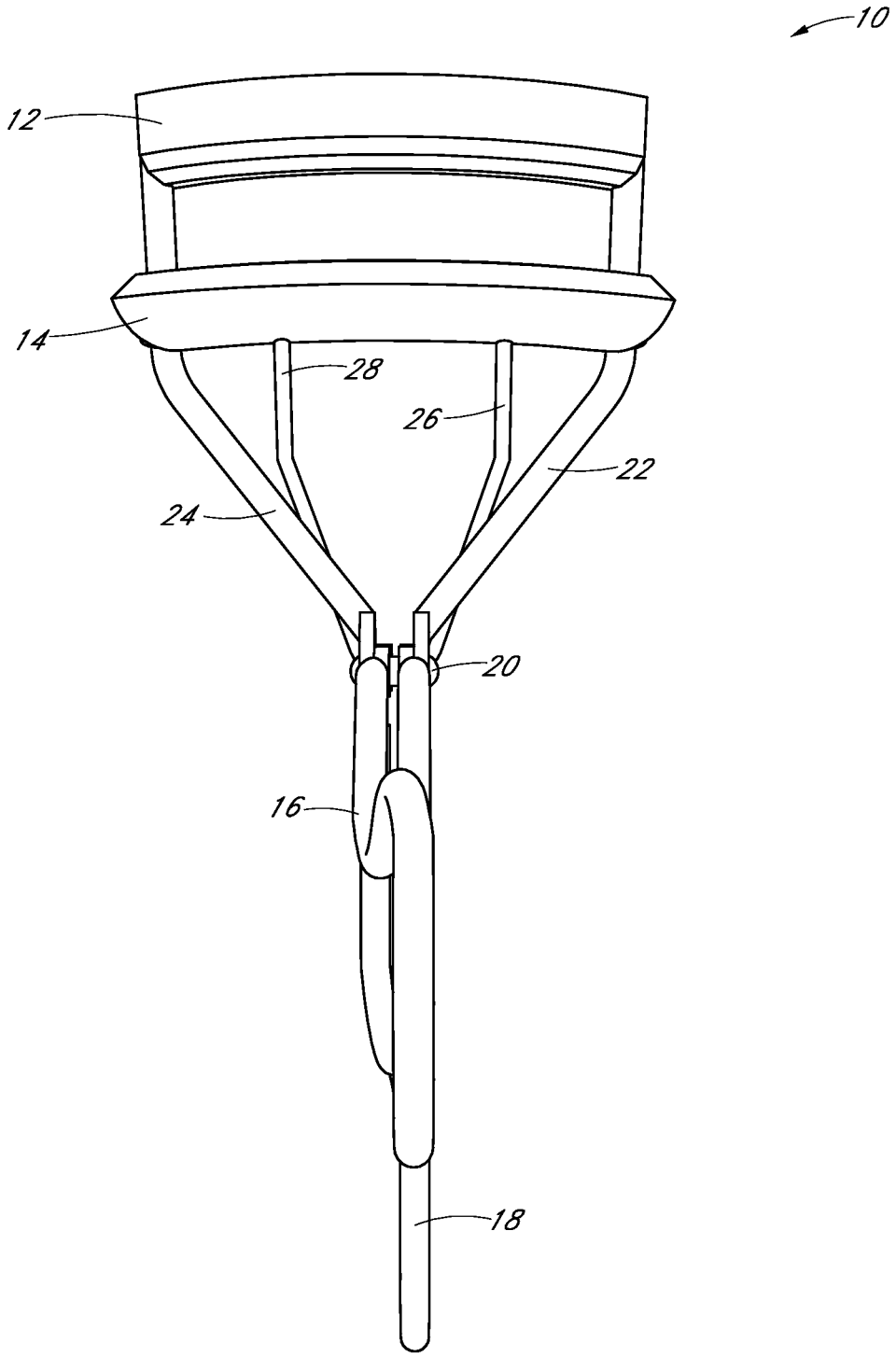
FIG. 4 is a front view of the eyelash curler of FIG. 1.
Figure 5:
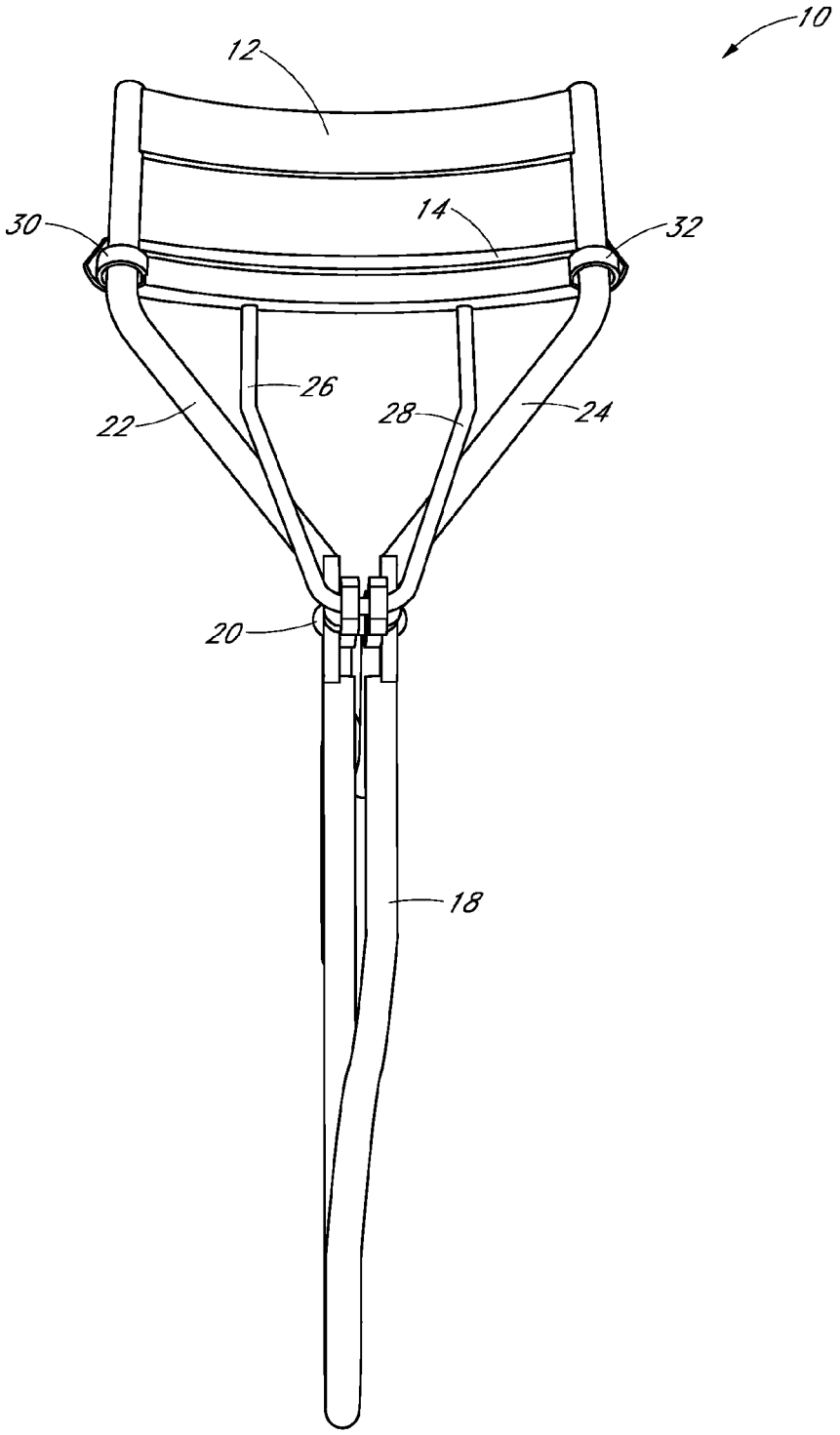
FIG. 5 is a back view of the eyelash curler of FIG. 1.

An eyelash curler can be used to curl a user's eyelashes. The user can position the eyelashes within the eyelash curler to then act on the eyelashes causing them to take on a desired shape or configuration. Generally this is done on the eyelashes of the upper eyelid. It is generally desired to obtain a natural looking curve of the eyelashes with the eyelashes bent to curve or curl upward, thereby enhancing the beauty of the eye by making it appear larger and more open.

An eyelash curler 10 is shown in FIGS. 1-5. As will be described in more detail below, the eyelash curler can use press forming, the application of pressure by squeezing, to shape the eyelashes to the desired configuration. The eyelash curler may also use heat to assist in the shaping of the eyelashes. Such heat can also enforce the curl and may help it last longer. To press form the eyelashes, one or more of at least two members 12, 14 can move relative to the other to squeeze the eyelashes between the two members. The at least two members 12, 14 can be moved in one of many different manners. As shown, a scissors-like structure can be used, but it will be understood that any structure can be used such as mechanical or electromechanical structures configured to move two objects closer together.

The illustrated scissors-like structure includes two pivotally connected handles 16, 18. A pin, rivet, screw, bar, or other structure 20 can be used to secure the handles 16, 18 together and allow them to rotate with respect to one another. The upper end of one of the handles 18 can have one or more upwardly extending support arms 22 and 24. The other handle 16 can be pivotally connected to one or more support arms 26 and 28. The two pairs of support arms 22, 24 and 26, 28 can be operatively coupled with one or more rings 30, 32 such that the rotational movement of the handles 16, 18 with respect to one another can cause a linear movement at the support arms 22, 24 and 26, 28.

As shown, member 12 is fixedly attached to support arms 22, 24 and member 14 is fixedly attached to support arms 26, 28. Member 14 is also fixedly attached to rings 30, 32. This allows member 14 and rings 30, 32 to slide up and down at least a portion of support arms 22, 24. This also allows member 12 and member 14 to engage one another and to press form, or apply pressure by squeezing, to any object between the members 12, 14 such as eyelashes. The members 12, 14 can be connected to pivoting handles 16, 18 so that the members 12, 14 can be slid towards and away from the one another by manipulation of the handles.

The eyelash curler 10 can be made of one or more different materials. For example, the eyelash curler 10 can be made of metal or plastic. In addition, portions of the eyelash curler 10 may be made of different materials. For example, either of members 12, 14 can be made of one or more materials and may include a powder coat finish to enhance durability and reduce smudging on the surface of the various assembly parts. Though the member 12 is shown as one solid piece of material, it will be understood that the member could include multiple layers of material that are the same or different. For example, member 12 could be made up of 3, 4, 5 or more layers of material. Each layer could have a bottom surface that when combined can form a type of rounded surface as will be described below.

Figure 6:
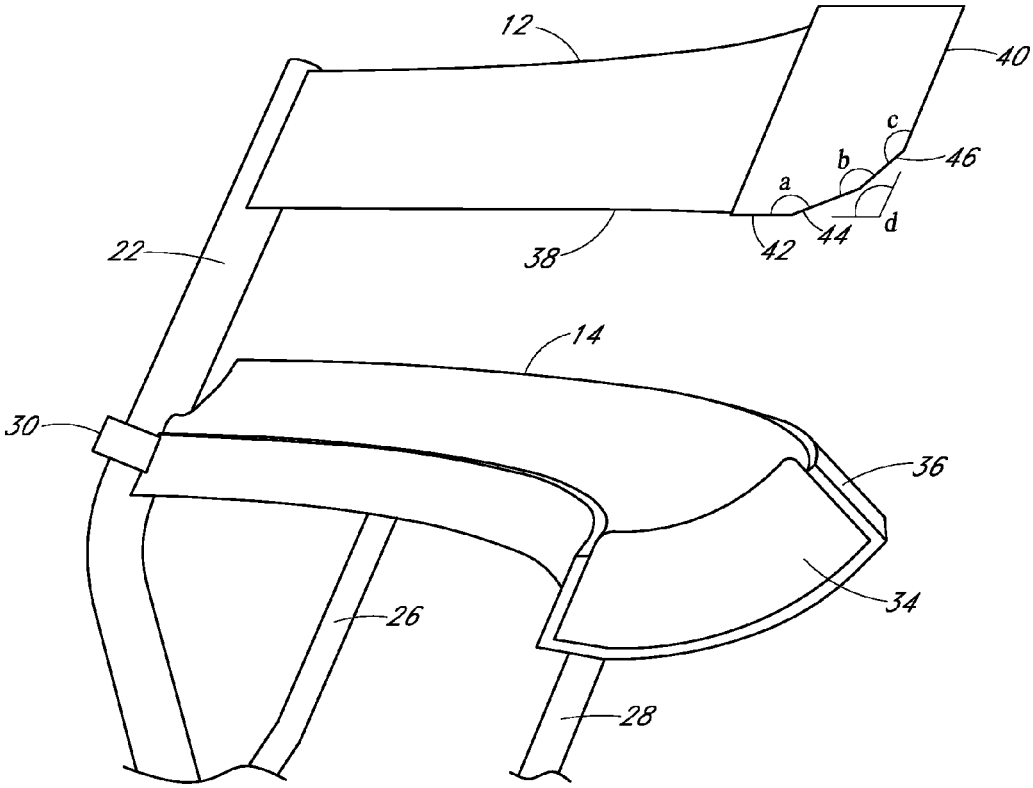
FIG. 6 is a schematic detail view of an eyelash curler in a first position.
Figure 7:
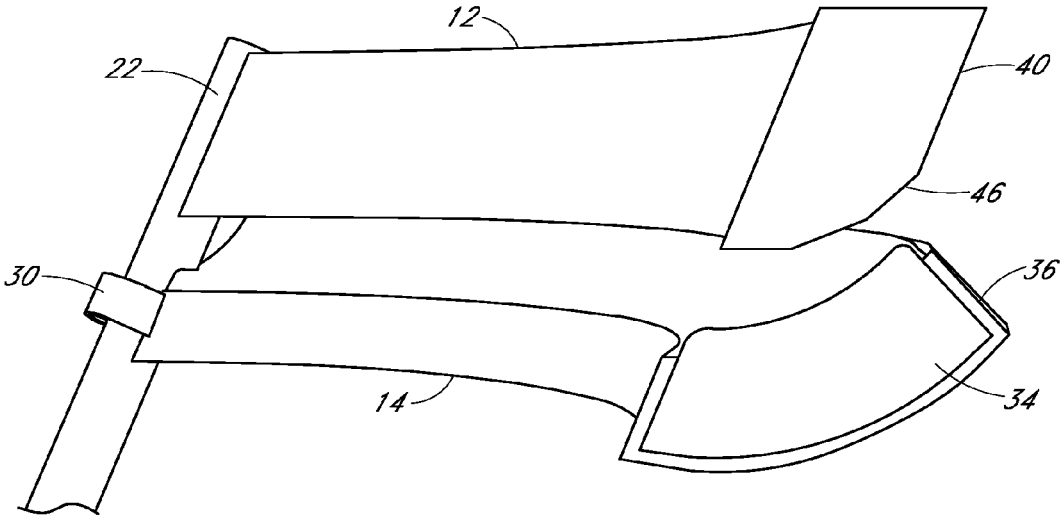
FIG. 7 is a schematic detail view of the eyelash curler of FIG. 6 in a second position.

Turning now to FIGS. 6 and 7, the members 12, 14 are shown in a first position spaced away from one another and a second position wherein member 14 has been moved closer to member 12. It can be seen that member 14 is made up of two separate materials such as a pad 34 and a platform or holder 36. The holder 36 can be made of metal and the pad 34 can be made of plastic, synthetic or natural rubber, silicone, etc. The holder 36 can hold the pad 34 with a friction fit, glue, adhesive, etc. As shown, the holder 36 is shaped to cradle and surround the pad 34 on three sides. Other configurations can also be used.

The pad 34 can be made of a material that is softer, more malleable, and/or more flexible than member 12. The pad 34 can also be a resilient material. This can allow the eyelash to be pressed into engagement with member 12 by the pad 34. The pad 34 may also surround the eyelash forcing it into engagement with member 12. Though the illustrated embodiment shows the member 12 on top and member 14 on the bottom, it will be understood that the members 12 and 14 can be switched such that the softer material is at the top of the eyelash curler and the harder material is below. It will also be understood that the members 12 and 14 may both move, or either one of 12 and 14 may move in relation to the other.

The members 12, 14 can extend horizontally between the respective support arms 22, 24 and 26, 28. The members 12, 14 can also be curved to fit the natural curvature of the eye. Members 12 and 14 can each have a respective surface contoured to engage, correspond, and/or substantially correspond with the surface of the other member. In some embodiments, the members 12 and 14 have surfaces that engage one another that are not corresponding shapes but are similar. For example, one shape may be rounded where the other shape may have a plurality of flat surfaces which in the aggregate form a type of rounded surface. In some embodiments, the member 12 or the member 14 may be wider as compared to the other as measured from the front to the back of the eyelash curler.

Looking at member 12, it can be seen that a bottom back edge 38 and a front surface 40 are connected with a series of additional linear surfaces 42, 44, 46. These edges and surfaces extend along the member 12 to form some of the various surfaces of the member 12. It will be understood that one or more of the edges may be rounded or smoothed out. For example, bottom back edge 38 can be a rounded edge.

As illustrated, the eyelash curler member 12 does not have a completely round or a completely hard or sharp edge between the front surface 40 and the bottom back edge 38. Such an edge and surface configuration of the member 12 can allow the eyelash curler to create a natural curl in the eyelash without crimping or forming a sharp, un-natural bend in the eyelash. The multiple ridges formed at each edge of the adjoining surfaces on the member 12 can also provide a longer lasting bend in the eyelash as compared to a purely rounded surface while also minimizing crimping. The ridges can also reinforce the curl using different points of pressure along the eyelash.

In some embodiments, the bottom back edge 38 and/or the surface 42 can be a lowest point of contact of a lash in the eyelash curler. A linear or rounded surface can extend upwards from the lowest point or surface of contact. For example, the back edge 38 can establish a lowest point of contact and then two, three (42, 44, 46) or more surfaces can extend upwards from that point to connect with the front surface 40. According to some embodiments, there can be multiple surfaces that define diagonal planes that are angled upwards from a horizontal plane or line defined by either one or both of the bottom back edge 38 and the surface 42. As has been mentioned these planes and surfaces may be flat but may also be rounded. Independent of the actual shape of the surface, a ridge or other landmark can distinguish where the two separate planes or surfaces are joined together.

As shown in FIG. 6, in some embodiments, the front surface 40 and the bottom back edge 38 can be positioned such that an angle "d" between the two surfaces is greater than or equal to 90 degrees. For example, the angle "d" can be about: 110, 112, or 115 degrees or between about: 105 and 120 degrees, 110 and 115 degrees, 100 and 110 degrees, and 110 and 120 degrees. The angles "a", "b", "c" between the different surfaces 38, 42, 44, 46, 48 can be the same or can vary. For example, angles "a", "b", "c" can be about: 150, 155, 160, 165, 170, or 175 degrees. Or the angles "a", "b", "c" can be between about: 150-175 degrees, 160-170 degrees, and 150-160 degrees. In some embodiments, angle "a" may be between about 150-160 degrees while angle "c" is between about 160-170 degrees to encourage a greater angle of curvature near the base of the lash. Alternatively, in some embodiments, angle "a" may be between about 160-170 degrees while angle "c" is between about 150-160 degrees to encourage a greater angle of curvature near the end of the lash.

The length and shape of the members 12, 14 can also be long enough to support most of, if not the entire lash during the pressing step as will be shown below. This can further help the eyelash curler 10 to provide a natural looking curve to the eyelash. This is in contrast to standard curlers that use shorter surfaces that create substantial crimps in the lash and require several successive squeezing maneuvers to impart a crimped curve. In addition, standard curlers often crimp the lash on one or both of the front side and the back side of the short crimping surface forming an unnatural L- or U-shaped bend in the lash. Further crimping may be required with these devices to achieve more of a curve in the lash. In some embodiments, the members may be supplied with different lengths to accommodate shorter and longer eye lashes.

It will be understood that multiple eyelash curlers of different sizes can be provided. Each eyelash curler can be shaped and sized to fit eyelashes of a particular length or eyelash lengths within a particular range. For example, two different sized eyelash curlers maybe sold. As another example, small, medium, large, and extra large; or small and regular; or regular and large, etc. sized eyelash curlers may be provided.

As another example, where two different sized eyelash curlers are provided, the width of the member 12 can be shorter on one curler than the other, while the width of the member 14 can remain the same. In some embodiments the width of member 12 can stay the same but there may be additional surfaces or some of the surfaces may be smaller to create a curve that starts closer to the back edge 38 as compared to the member 12 of the other curler.

In this way, the number of different parts can be reduced while producing two different sized eyelash curlers. Preferably, there can be two different parts for member 12, and the rest of the parts can be interchangeable for the two different sized eyelash curlers. In addition, the support arms 22, 24 can be made to receive or connect to the two different variations of member 12. For example, support arms 22, 24 can include a hole to receive the member 12 and the variations of member 12 can have the same sides so as to allow the different variations to be received into the same hole. Positioning the member 14 at an angle can also facilitate this arrangement where the different sized members 12 can fully engage the member 14 in a desired manner. In some embodiments, the member 14 can also be specific to the size of the eyelash curler.

Turning now to FIGS. 8A through 8D, a method of curling an eyelash with an eyelash curler is shown. First, the eyelash curler can be placed such that the member 12 is close to the eye of the user. An eyelash 50 is shown positioned between the member 12 and the member 14. The handle 16 can be rotated to bring it closer to handle 18. This causes the member 14 to slide upwards towards member 12. Alternatively, other mechanisms can be used to bring member 14 and member 12 close to together, such as pressing a button, or sliding a lever. As the eyelash 50 is positioned between the member 12 and the member 14, the eyelash will begin to be encouraged towards member 12 by the movement of member 14.

Figure 8B:
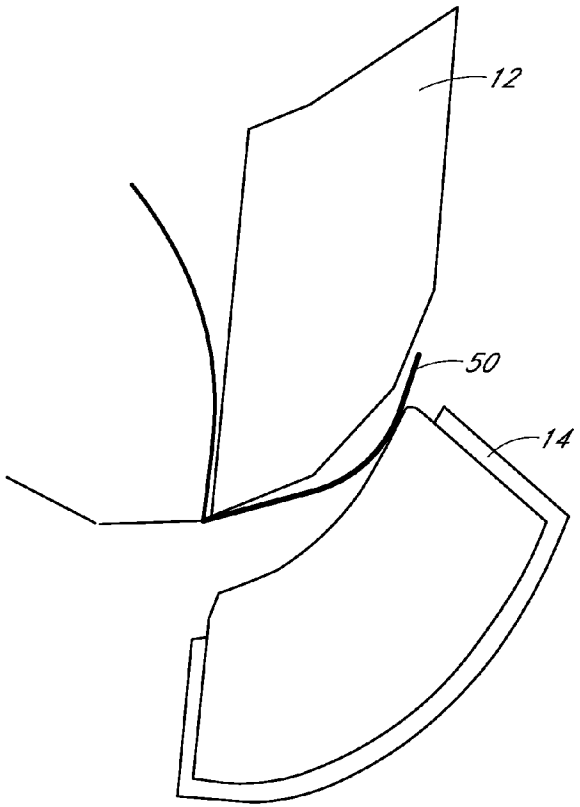
FIGS. 8A-8D show a method of curling eyelashes with an eyelash curler.
Figure 8A:
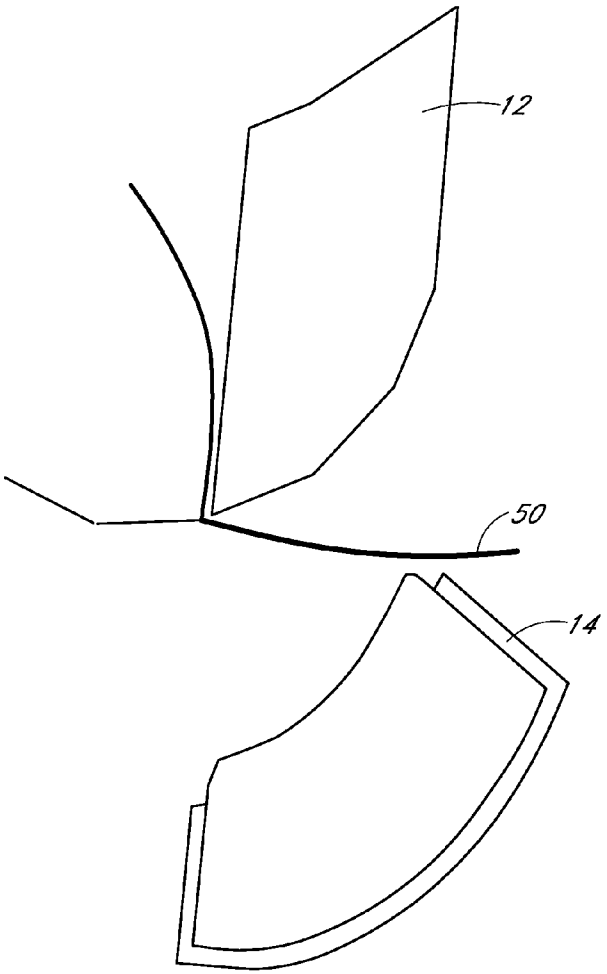
Figure 8D:
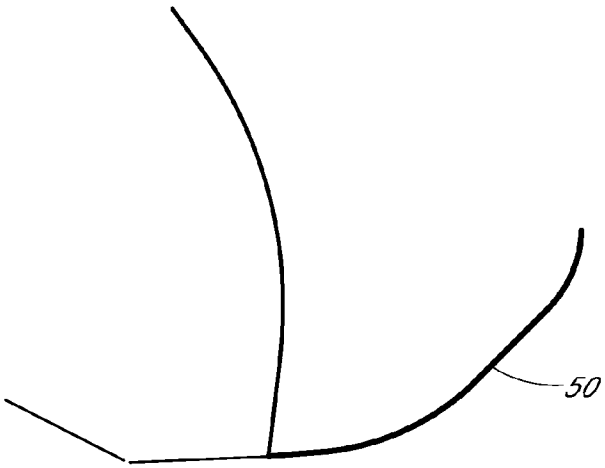
Figure 8C:
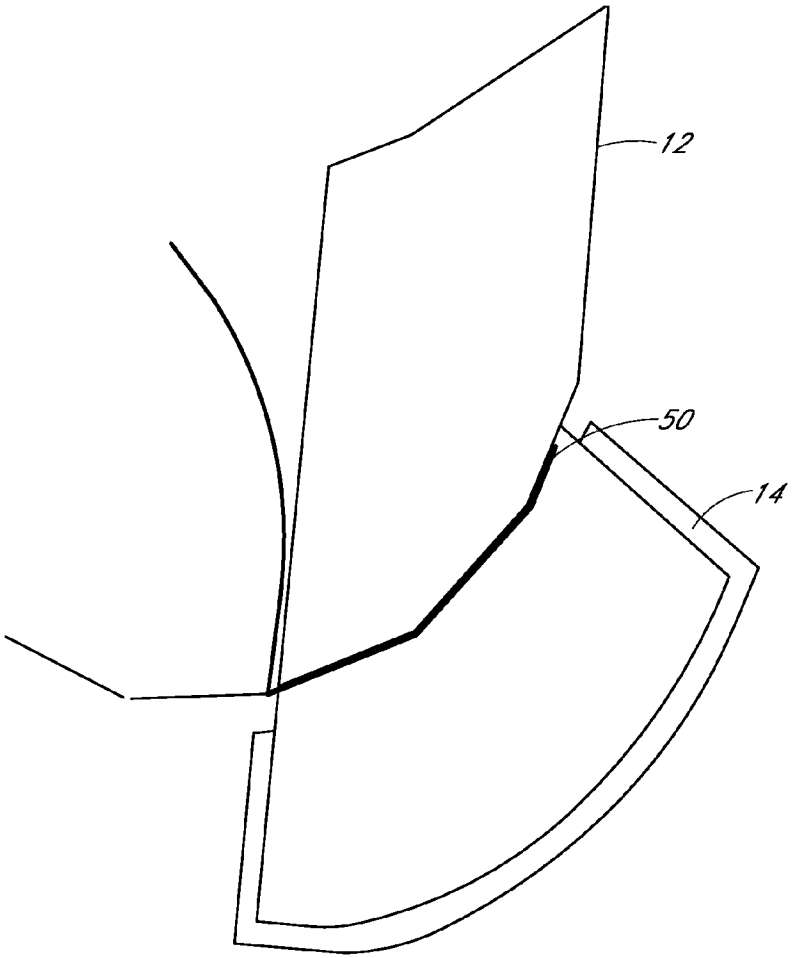

FIG. 8C illustrates the eyelash 50 being press formed between the member 12 and the member 14. It can be seen that the eyelash curler can fully or mostly support the eyelash 50 along the entire length of the eyelash. For example, the eyelash can be positioned completely within the corresponding and engaged surfaces on members 12 and 14. Such engagement can encourage the eyelash to take on a natural-like curve. Such engagement can also help ensure that the eyelash does not become crimped or pinched to bend in an unnatural-like manner.

As can be seen, the eyelash 50 can take on the shape of, or substantially the shape of the member 12 as the member 14 with the softer material 34 also conforms to the shape of the outer surfaces of member 12. Once released from the eyelash curler, the eyelash 50 as shown in FIG. 8D can take on a natural looking curve.

As has been mentioned the eyelash curler can also be heated. Heat can assist in the shaping of the eyelashes. For example, the eyelash curler can be heated with a hair dryer. As another example, the eyelash curler may have its own heat source to heat the eyelashes between members 12 and 14.

Figure 8E:
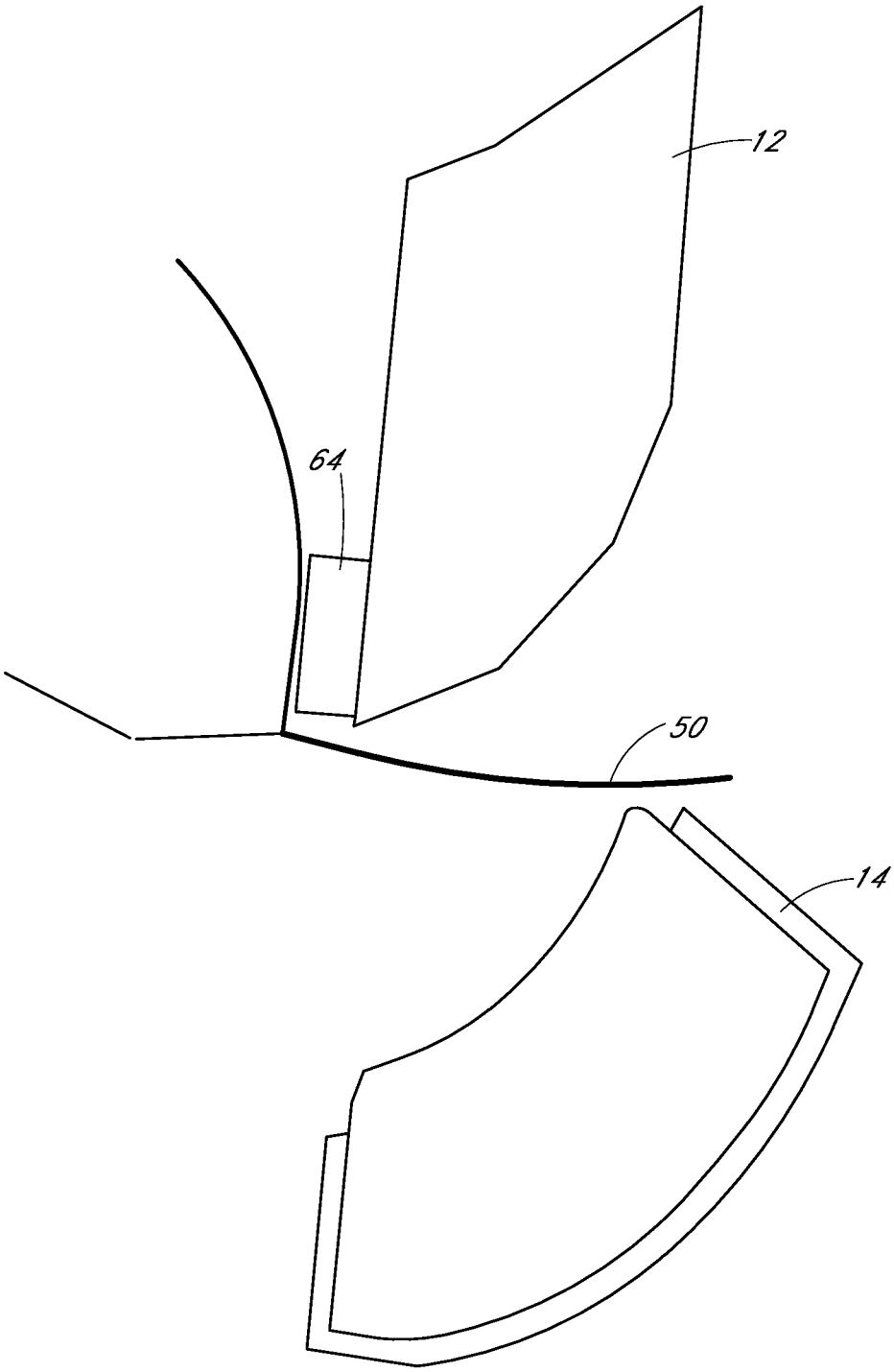
FIG. 8E shows another embodiment of an eyelash curler.

In some embodiments, the eyelash curler 10 can further include a spacer 64 to maintain a space between eyelash curler and the eyelid to further reduce pinching. The spacer 64 can be located in many different positions along the eyelash curler 10. In some embodiments, a small strip or band can be made integral with or attached to either of the members 12 and 14. For example, the small strip 64 can be placed on the back of the member 12 above the edge 38 as is shown in FIG. 8E. The strip 64 can be sufficiently thick to maintain a desired spacing between the member 12 and the eyelid. In some embodiments, the strip 64 can be positioned adjacent to edge 38.

Figure 9C:
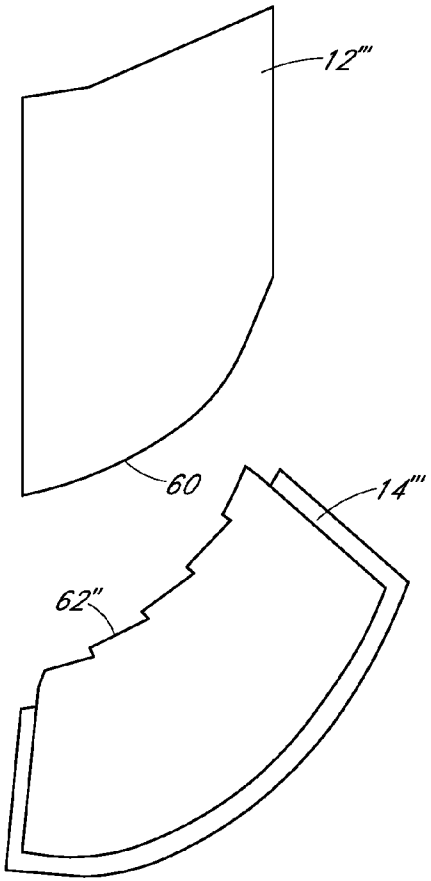
FIGS. 9A-9C illustrate schematic cross-sections of parts of eyelash curlers.
Figure 9B:
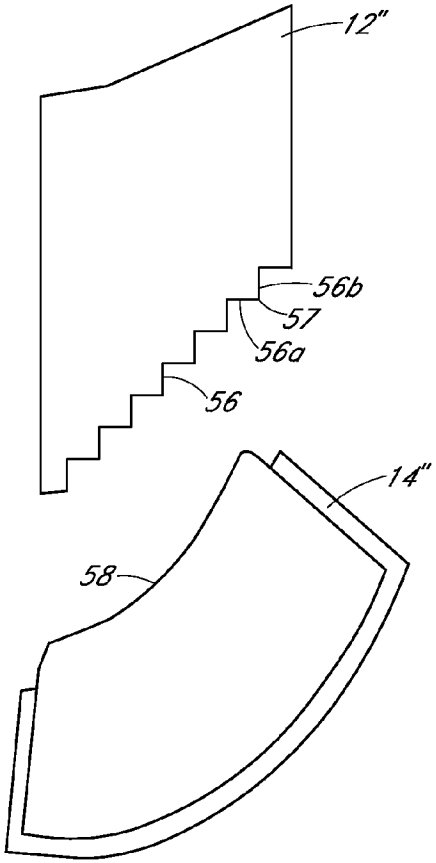
Figure 9A:
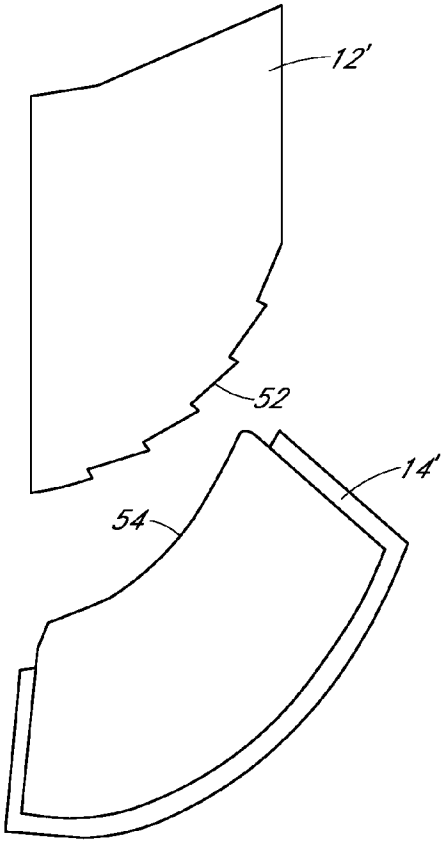

Looking now to FIGS. 9A, B and C, a portion of three different eyelash curlers are shown. FIG. 9A shows an eyelash curler with members 12' and 14'. Members 12' and 14' are shown having corresponding surfaces 52 and 54. Though shown schematically, the surface 52 preferably comprises a micro finish along the curve of the surface 52 to encourage the lash to curl without fully crimping the lash. The micro finish on the surface 52 can include a texturing of the surface, such as with a multitude of cross hatchings that create a multi-ridged surface that engages the pad 14'. The micro finish on the surface 52 can have a fine texturing or a relatively rough texturing. For example, the fine texturing could be imperceptible to the touch. In some embodiments, the ridges may be left sharp or may be further processed to round them off, for example by polishing or buffing the surface. The pad 14' can have a smooth or relatively smooth surface 54 that engages the micro finish surface 52. The micro finish surface can provide multiple pressure points that act to reinforce the curve and encourage a natural curve while minimizing the crimp typical of regular curlers.

Either of members 12' and 14' may be the harder material or the softer material. For example, 14' may be a hard metal material and 12' may be a softer plastic or rubber material. The same holds true for the members 12", 12'" and 14", 14'" in FIGS. 9B and 9C. In some embodiments, the textured surface is on the softer pad and a smooth surface is on the harder material.

As shown in FIG. 9B, the member 12" has a step surface 56. The step surface has number of steps with generally straight linear segments between them. The steps can be even or uneven and can provide the same, a gradient, or different changes in height across the surface of the member 12". The steps and linear segments can form a number of ridges which extend along the surface 56. Member 14" has a curved surface 58 that can engage the surface 56. In some embodiments, the outer points of surface 56 define a curve similar to the curved surface 58. In some embodiments, the surface 56 is defined by a series of flat sub-surfaces 56*a*, 56*b* that are joined by generally 90 degree angles between them. In some embodiments, the angle may vary across the different steps and may be greater or less than 90 degrees such that the sub-surfaces are angled linear segments. In some embodiments, the depth of each step between the surfaces is small so as to minimize crimping of the lash. In some embodiments, the corners 57 formed by the sub-surfaces 56*a*, 56*b* are left sharp. In some embodiments, the corners 57 are processed to round them off, for example by polishing or buffing. The corners 57 generally define a curved surface to engage the lash between members 12" and 14".

In FIG. 9C, member 12'" has a curved surface 60 and 14'" has a step surface 62. Though the step surface 62 of member 14'" is generally softer than the curved surface 60 of member 12'", the material has sufficient durometer to impart a natural curve to the lash while minimizing crimping thereto.

It will be understood that the corresponding surfaces of 12 and 14 that engage one another can have the same or different shapes. For example, the shapes can be corresponding to engage and match up similar to matching puzzle pieces, or the shapes may be completely or mostly different. In some embodiments, the softer material may have a different shape than the harder material, but may still fully engage or mostly engage the surface of the harder material. For example, the softer material may deform to take on the surface configuration of the harder material.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. An eyelash curler comprising:

a first member comprising:

a back surface;

a front surface opposite the back surface, said front surface being shorter in length than said back surface;

a bottom surface connecting the back surface and front surface at a bottom of the first member;

a second member comprising a rounded top surface;

wherein either the first member of the second member is configured to move with relation to the other in a generally vertical manner, the bottom surface of the first member and top surface of the second member configured for press forming eyelashes between them;

wherein one of the first member and the second member is made of a more flexible or softer material than the other;

wherein the first member has a plurality of ridges that extend generally horizontally along the bottom surface to reinforce a curl that is pressed into an eyelash, the bottom surface comprising a plurality of steps made up of linear segments wherein the plurality of ridges are formed by the steps such that the plurality of ridges in the aggregate form a type of rounded surface such that the bottom surface extends upwardly from the back surface to the front surface.

2. The eyelash curler of claim 1, further comprising two handles pivotally connected, one of the two handles being rigidly attached to one of the first member and the second member.

3. The eyelash curler of claim 1, wherein the bottom surface of the first member comprises a micro textured surface.

4. The eyelash curler of claim 1, wherein the steps of the plurality of steps have different changes in height across the bottom surface.

5. The eyelash curler of claim 1, wherein the plurality of steps have generally 90 degree angles between the respective linear segments forming each step of the plurality of steps.

6. The eyelash curler of claim 1, wherein the bottom surface of the first member extends from a bottom most edge of the first member to a front most edge of the first member.

7. The eyelash curler of claim 1, wherein the bottom surface of the first member extends from a back most edge of the first member to a top most edge of the first member.

8. An eyelash curler comprising:

a first member comprising:

a front;

a back opposite the front, where said front is shorter in length than said back opposite the front;

a first side and a second side each side being adjacent the front and the back;

a top; and a bottom comprising a plurality of steps each formed generally by generally straight linear segments having a generally 90 degree angle between the one or more adjacent linear segments, the plurality of steps forming a plurality of ridges that extend from the first side to the second side and which collectively define an upwardly extending curved that extends from the back to the front;

a second member configured to mate with the bottom;

wherein either the first member or the second member is configured to move with relation to the other, the first and second members configured for press forming eyelashes between them;

wherein one of the first member and the second member is made of a more flexible or softer material than the other.

9. The eyelash curler of claim 8, further comprising two handles pivotally connected, one of the two handles being rigidly attached to one of the first member and the second member.

10. The eyelash curler of claim 8, wherein the bottom further comprises a micro textured surface.

11. The eyelash curler of claim 8, further comprising a spacer extending from the back of the first member and configured to engage an eyelid of a user.

12. The eyelash curler of claim 1, further comprising a spacer extending from the back of the first member.

13. An eyelash curler comprising:

a first member comprising:

a back surface;

a front surface opposite the back surface, said front surface being shorter in length than said back surface;

a bottom surface connecting the back surface and front surface at a bottom of the first member, said bottom surface comprising a plurality of linear segments that create a plurality of steps, each step having an outermost edge, the plurality of steps extending upwardly such that the collective outmost edges of the plurality of steps form a generally upwardly extending curve; and a second member having an arcuate surface, the arcuate surface extending in curved orientation corresponding with the generally upwardly extending curve of the bottom surface, thereby being configured to mate with and engage the edges of the first member to receive an eyelash therebetween, the bottom surface being harder than the arcuate surface, and the first member or the second member being configured to move with relation to the other in a generally vertical manner.

14. The eyelash curler of claim 13, wherein the steps are even to provide the same change in height across the first stepped surface.

15. The eyelash curler of claim 13, wherein, the plurality of linear segments are joined with generally 90 degree angles between them.

* * * * *

UNITED STATES PATENT AND TRADEMARK OFFICE

CERTIFICATE OF CORRECTION

PATENT NO. : 8,720,454 B2
APPLICATION NO. : 13/626768
DATED : May 13, 2014
INVENTOR(S) : Veronica Santillan It is certified that error appears in the above-identified patent and that said Letters Patent is hereby corrected as shown below:

IN THE CLAIMS:

At column 7, line 47, in Claim 1, change “front” to --the front--.
At column 7, line 50, in Claim 1, change “of” to --or--.
At column 7, line 53, in Claim 1, change “top” to --the top--.
At column 8, line 25, in Claim 8, change “second side” to --second side,--.
At column 8, line 29, in Claim 8, change “generally by” to --by--.
At column 8, line 63, in Claim 13, change “upwardly” to --generally upwardly--.
At column 8, line 64, in Claim 13, change “outmost” to --outermost--.

Signed and Sealed this
Second Day of December, 2014

Michelle K. Lee

Michelle K. Lee
*Deputy Director of the United States Patent and Trademark Office*